US008596728B2

(12) United States Patent
Rozestraten

(10) Patent No.: US 8,596,728 B2
(45) Date of Patent: Dec. 3, 2013

(54) TELEVISION CABINET

(75) Inventor: Reinier I. J. Rozestraten, Amsterdam (NL)

(73) Assignee: ER Wonen, Amsterdam (NL)

( * ) Notice: Subject to any disclaimer, the term of this patent is extended or adjusted under 35 U.S.C. 154(b) by 48 days.

(21) Appl. No.: 13/328,200

(22) Filed: Dec. 16, 2011

(65) Prior Publication Data

US 2012/0153788 A1 Jun. 21, 2012

(30) Foreign Application Priority Data

Dec. 16, 2010 (NL) ..... 2005867

(51) Int. Cl.
*A47B 5/00* (2006.01)
*A47B 81/06* (2006.01)
*A47B 95/02* (2006.01)

(52) U.S. Cl.
USPC ..... 312/7.2; 312/319.5

(58) Field of Classification Search
USPC ..... 248/917, 918, 919, 920, 921, 922, 923, 248/276.1, 281.11; 312/7.2, 21, 22, 23, 24, 312/25, 26, 27, 28, 30, 310, 325, 271, 275, 312/276, 319.1, 319.2, 319.3, 319.4, 319.5, 312/319.6, 319.7, 319.8; 108/20, 21, 38, 108/50.1, 50.2, 145, 138
See application file for complete search history.

(56) References Cited

U.S. PATENT DOCUMENTS 5,273,352 A * 12/1993 Saper ..... 312/7.2
6,288,891 B1 * 9/2001 Hasegawa et al. ..... 361/679.07
6,416,027 B1 * 7/2002 Hart ..... 248/324
6,484,993 B2 * 11/2002 Huffman ..... 248/323
6,585,214 B1 * 7/2003 Dittmer ..... 248/370
6,637,818 B2 * 10/2003 Williams ..... 297/330
6,783,198 B2 * 8/2004 Rudd et al. ..... 312/319.8
6,991,199 B2 * 1/2006 Carpentier ..... 248/122.1
7,201,108 B2 * 4/2007 Eusebi et al. ..... 108/76
7,661,643 B2 * 2/2010 Oh ..... 248/289.11
7,780,131 B2 * 8/2010 Oh ..... 248/276.1
8,276,857 B2 * 10/2012 Cvek ..... 248/132
2008/0116771 A1 5/2008 Green et al.
2009/0032656 A1 * 2/2009 Oh ..... 248/205.1
2009/0050757 A1 * 2/2009 Oh et al. ..... 248/205.1
2009/0057514 A1 * 3/2009 Oh ..... 248/282.1
2009/0109352 A1 * 4/2009 Lewis et al. ..... 348/837
2009/0159768 A1 * 6/2009 Oh ..... 248/284.1
2010/0102181 A1 * 4/2010 Oh ..... 248/201

FOREIGN PATENT DOCUMENTS

GB 2427127 12/2006
WO WO-2006134369 12/2006
WO WO-2010046731 4/2010

* cited by examiner

*Primary Examiner* — Joshua J Michener
*Assistant Examiner* — Kimberley S Wright
(74) *Attorney, Agent, or Firm* — Peacock Myers, P.C.; Jeffrey D. Myers

(57) ABSTRACT

A cabinet comprising a holder for attachment of a device comprising a display screen, such as a television device, wherein the cabinet at least comprises a horizontal panel. The cabinet comprises an arrangement for moving the display screen device between two positions, wherein in a first position, called storage position, the display screen is stored below the horizontal panel with the display screen in a lying position and in a second position, called operating position, the display screen is situated externally of the cabinet above the horizontal panel with the screen in standing, essentially vertical position.

12 Claims, 20 Drawing Sheets

TELEVISION CABINET

CROSS-REFERENCE TO RELATED APPLICATIONS

This application is a continuation application of Netherlands Patent Application Serial No. 2005867, entitled "Television Cabinet", filed on Dec. 16, 2010, and the specification and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to a cabinet comprising a holder for attachment to the holder of a device comprising a display screen, such as a television device or a computer monitor. In cases where a television device is mentioned hereafter a device comprising a display screen is meant and also other devices with a display screen other than a television device, such as a computer monitor are considered to be included.

2. Description of Related Art

Such cabinets have been known. In many cases it concerns cabinets in which a dedicated position is reserved for a television device, so that when the device is not in use, the television device with the screen remains visible. A switched off television screen usually does not provide a pleasant sight.

Other television cabinets are known, wherein when the television device is not in use can be screened off by means of closable doors that close in front of the screen or by a venetian blind that can slide up and down.

The known television cabinets have the disadvantage that they are arranged for accommodating a television device.

GB 2 427 127 A1 describes a mounting for a retractable user interface with means to slide away part of a surface to create an opening in the surface in which the user interface can be deployed.

WO 2010/046731 A1 describes a computer table with a working surface of which a proximal part can pivot upwards to create space so that a distal part can move between a lower position and a raised position, whereby the distal part comprises a computer display. After the movement of the distal part a proximal part can move back to its original position.

US 2008/0116771 A1 describes a cabinet in which a flat screen television device is mounted at the inside of a top panel of the cabinet. The top panel is mounted pivotally to the body of the cabinet. A lifting mechanism attached between the top panel and another part of the cabinet entirely lifts up the top panel or provides assistance to open the top panel.

BRIEF SUMMARY OF THE INVENTION

There is a need for a cabinet that can be equipped with a television device, but that also is usable for other purposes than accommodating a television device and wherein the television device is not visible when it is not in use.

This need is met by a television cabinet according to claim 1. The advantage of such a cabinet is that it comprises a horizontal panel, through which the cabinet can be used as a table, a coffee table or a side table. It is also possible that the cabinet is part of a buffet table or a wall cabinet, wherein the horizontal panel can be used to support a variety of things. In the operating condition the holder (to which during use a television device has been attached) is situated at a certain height above the panel, for example approximately 20 cm so that an ample number of articles can be accommodated on the panel without this bothering the function of watching the television screen. When the holder is in the storage position, there is nothing on or at the cabinet that gives the impression of a television cabinet. Inside the cabinet according to the invention use is made of only one drive that enables all the movements that are possible with the television cabinet according to the invention using this single drive.

In the embodiment as described in claim 2, the holder is slidably connected with the bracket and thus the holder, during moving to the operating position, can move upwards along the bracket by means of the pulling cable. Through this a higher position of the holder above the horizontal panel is obtained, without requiring additional space in the storage position under the horizontal panel.

In a preferred embodiment the horizontal panel is moved away and moved back again in such a way that the horizontal panel maintains its horizontal orientation. When the horizontal panel is divided into two parts the maintenance of the horizontal orientation is in any case valid for one of the two parts. Because of this the various pieces that are positioned on the panel do not need to be removed and can remain where they are during movement of the television device from the storage position to the operating position and vice versa.

A special advantage of the cabinet according to the invention is that during movement of the holder (during use with the television device attached) from the storage position to the operating position and back again, only the horizontal panel, respectively a part thereof, moves outside the vertical contours of the cabinet. However, it is easily arranged that this is not posing any problems. The holder (during use with the television device attached) itself remains completely inside the vertical contours of the cabinet.

The cabinet according to the invention, it is preferred that in the storage position not only the holder but all elements of the device for moving the holder between the storage position and the operating position and vice versa, are placed below the horizontal panel and are thus not visible from the outside. When the holder is in the operating position it is clear that the holder itself is visible and also the bracket will be visible. In a preferred embodiment of the invention in addition to the bracket, the pivoting arm and the first pulling cable are visible above the horizontal panel, while all other parts of the device remain below the horizontal panel. It is possible that the horizontal panel comprises an opening through which these parts in the operating position of the holder are extending upwards. It is also possible that the horizontal panel comprises a pivoting part that in the operating position the holder is turned out of the plane of the panel to provide passage to the parts extending through the horizontal panel, being the bracket, the pivot arm and the first pulling cable.

Preferably the drive comprises an electromotor with a transmission that connects the electromotor with the slide. This transmission can comprise a pulling cable for transmitting the movement of the electromotor to the slide, but this can also be done using, e.g., a screw spindle.

When the horizontal panel, respectively a major part thereof, remains horizontal during the movement, pieces that have been placed thereon can remain in their position during this movement. In the case of the embodiment, for example where the cabinet functions as a coffee table, drinks could be located on the table, such cups of coffee, tea or glasses with other drinks. In that case it is advantageous that the cabinet according to the invention is arranged in such a way that during the movement there is no or a very limited possibility that some of the drinks are spilled over the table. Therefore it is in a preferred embodiment of the invention that the drive comprises a control such that the part of the horizontal panel that keeps its horizontal position during movement is controlled in such a way that this undergoes only limited acceleration that does not exceed a predefined threshold value. In such a way a preferred embodiment of the invention can be arranged so that the movement is very smooth and all matters that are positioned on top of the horizontal panel can keep their position.

BRIEF DESCRIPTION OF THE SEVERAL VIEWS OF THE DRAWINGS

The invention will now be further explained using a description of a preferred embodiment of the invention, also with reference to the attached drawings, wherein.

DETAILED DESCRIPTION OF THE INVENTION

In a preferred embodiment of the cabinet according to the invention the drive can be operated by remote control, so that using a remote control device the user can switch from storage position to operating position and from operating position to storage position.

First, it is noted that not all figures comprise all reference numbers. For each series of figures only reference numbers are indicated thereon where they are most clear for understanding the operation of the embodiment of the invention shown.

The overall operation will be described with reference to FIGS. 1*a-e.*

Figure 1A:
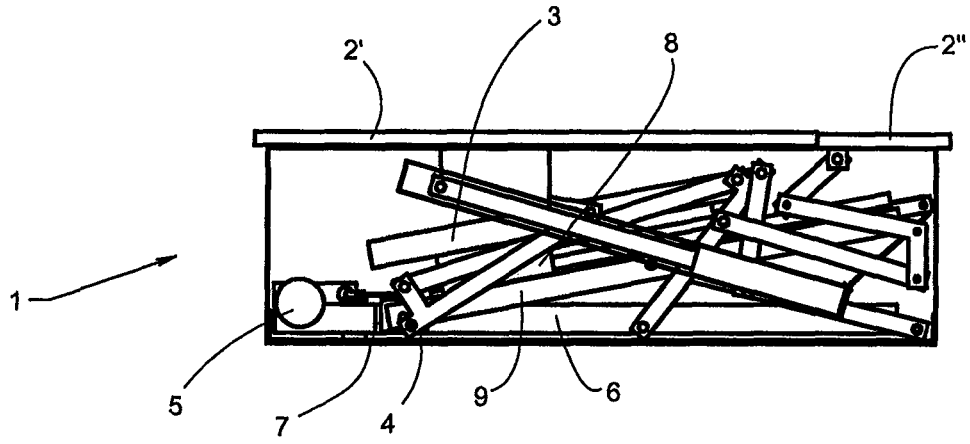
FIGS. 1*a-e* show a side view of a cabinet according to the invention with a display screen, visual monitor or television device that moves from storage position to operating position.

FIG. 1*a* shows a cabinet 1 with a horizontal panel 2 that is divided in two parts, 2' and 2", in which below the horizontal panel 2', 2" a display screen, visual monitor or television device 3 is situated in the storage position. The horizontal panel in this embodiment is divided into two parts, being a part 2', which comprises the largest part of the horizontal panel, and a part 2" that forms the smallest part of the horizontal panel. The division between the parts 2', 2" of the upper panel is chosen in such a way that the part 2" is as small as possible, but in the operating position those parts of the device for moving the holder and television device that necessarily have to be located behind the television device, are located below or above the parts 2". The rear side of the television device in the operating position is essentially right above the dividing line between the parts 2', 2" of the horizontal panel. The horizontal panel 2', 2" is rectangular in shape and in the stationary position is at the bottom side in contact with four vertical panels that extend downwards. These panels are part of a frame 4 that is comprised in the stationary part of the cabinet. The cabinet 1 shown in the figures can be part of a table, such as a coffee table, but the part shown can also be part of for instance a wall cabinet. In the figures the part shown is limited to the parts that are essential for understanding the operation of the cabinet according to the invention. The frame 4 is fixed to the cabinet and is therefore supported by those parts of the cabinet that have not been shown in the figures.

The drive is formed by an electromotor 5 that via transmission, can operate a screw spindle, that is not visible in the drawing, that is connected with slide 7. Slide 7 is slidably connected with a guide 6 and can move via guide 6 from a first stationary position, shown in FIG. 1*a* and which is close to one end of the guide 6 near to the drive with electromotor 5 when in the stationary cabinet storage position with the visual screen/television device 3, to a second stationary position that belongs to the operating position of the visual screen/television device 3 and is situated near to the other end of the guide 6. In the storage position the screen of the visual screen/television device forms an angle with the horizontal plane, thus with the horizontal panel 2 in position of rest, of approximately 10 degrees. With such a small angle the required space for the visual screen/television device 3 in the storage position is minimal, while the angle is sufficient to exert an upward force on the television screen 3 with movement of the slide 7 from the first stationary position over guide 6 together with pivoting arm 10. In this embodiment the angle that pivoting arm 10 forms with the visual screen/television device 3 and holder 8 is decisive. This angle can be achieved in different constructive ways, which different ways are forming equivalents of the present invention. Slide 7 can also be moved in the reversed direction by electromotor 5 from the second stationary position that belongs to the operating position of the television screen 3 to the first stationary position that belongs to the storage position of the visual screen/television device 3. Slide 7 is pivotally connected with bracket 9 along which holder 8 of visual screen/television device 3 is movable in the longitudinal direction. Further details of the moving mechanisms will be explained below.

Figure 1B:
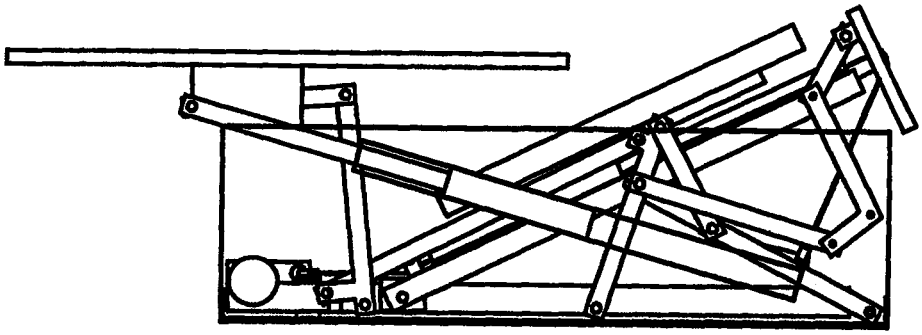
Figure 1C:
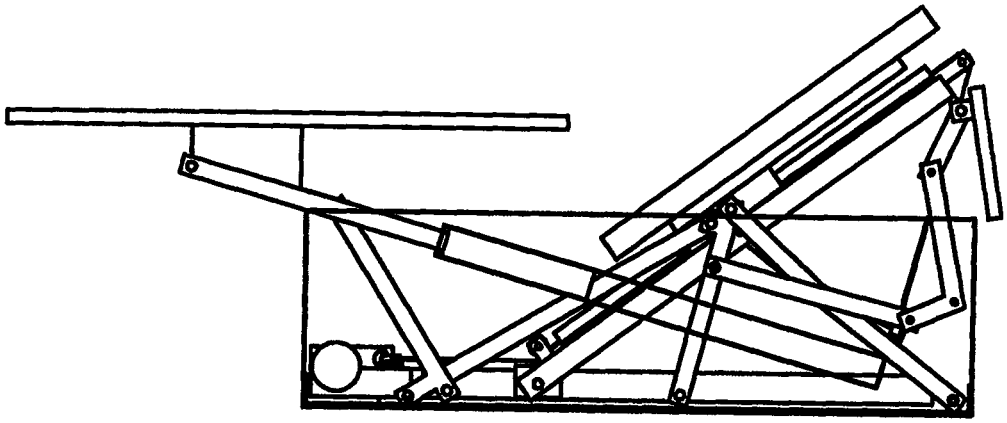
Figure 1D:
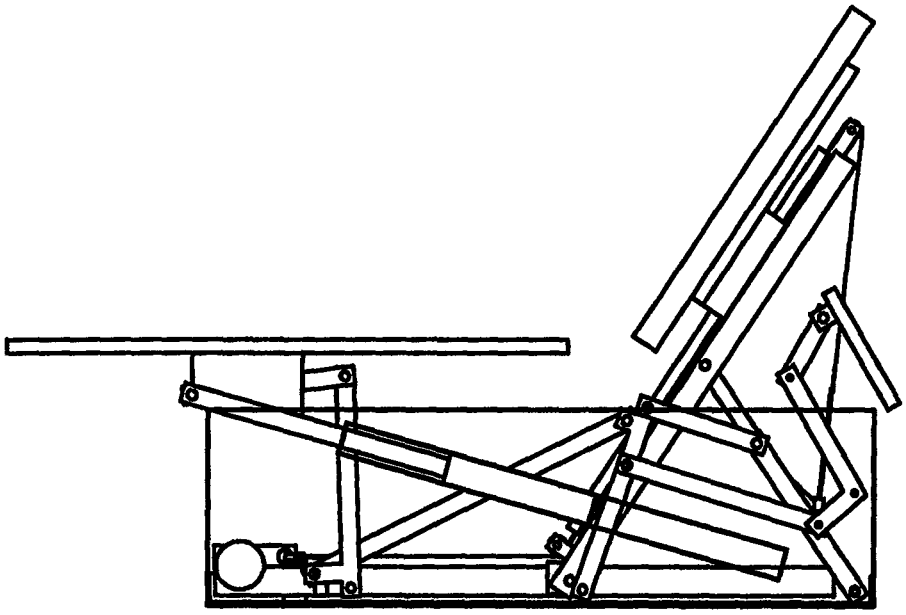
Figure 1E:
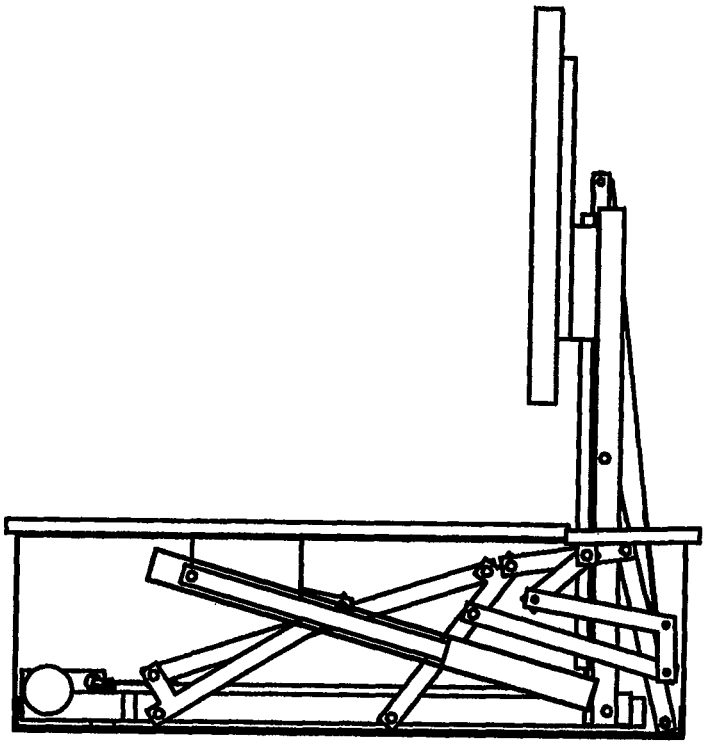

In moving slide 7 from the first stationary position, as is shown in FIG. 1*a* to the second stationary position as is shown in FIG. 1*e*, by this movement an mechanism is activated that has as consequence a number of movements. In FIG. 1*b* can be seen that the part 2' of the horizontal panel has translated upwards and somewhere to the left in the drawing, remaining parallel to its original horizontal position. At the same time the horizontal part 2" pivots around an axis that is situated at an end of the part 2". At the same time holder 8 with visual screen/television device 3 has slid upwards along bracket 9 and bracket 9 is pivoted upwards along the pivoting connection with slide 7. The movements that are described between FIGS. 1*a* and 1*b* are continued between the FIGS. 1*b* and 1*c*. In FIG. 1*c* therefore the part 2' of the horizontal panel has moved further upwards and outwards and the part of the horizontal panel 2" is pivoted practically vertically upwards, while holder 8 with the visual screen/television device 3 has slid further upwards along bracket 9 and bracket 9 is pivoted upwards further so that it forms a larger angle with the horizontal plane. In FIG. 1*d* the upward movement of the holder 8 with the visual screen/television device 3 along bracket 9 has continued and also the erection of bracket 9 has continued to a position that is closer to the vertical position. The part 2' of the top panel has moved back with respect to the position that is shown in FIG. 1*c* to a position that approximately coincides with the position that is shown in FIG. 1*b* and the same goes for the position of the part 2" of the top panel. In FIG. 1*e*, finally, is shown that slide 7 is located in the second stationary position along guide 6 and the parts 2' and 2" are back to the horizontal starting position that is shown in FIG. 1*a* and the visual screen/television device 3 is now in the operating position.

Figure 2A:
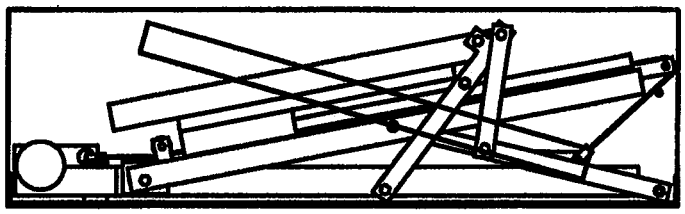
FIGS. 2*a-e* show a view similar to that of FIG. 1, in which only the elements that are important for the movement of the a display screen, visual monitor or television device are shown.
Figure 2F:
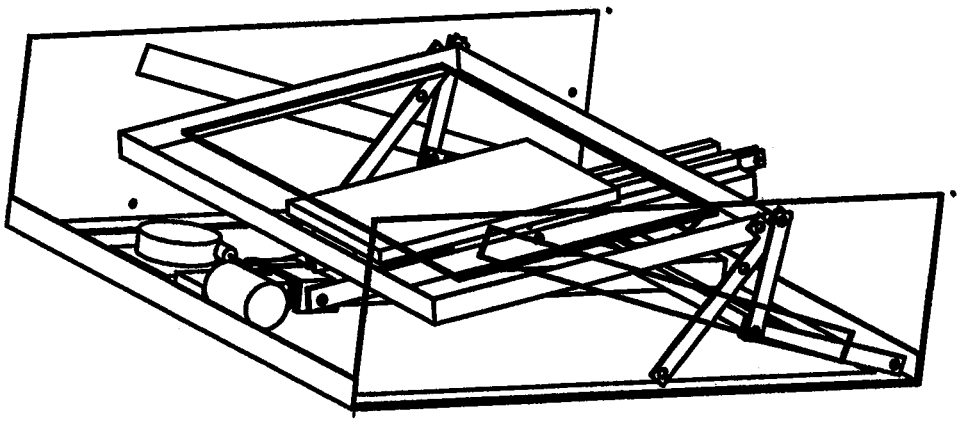
FIGS. 2*f-j* show a view in isometric perspective of the steps of FIGS. 2*a-e;*
Figure 2B:
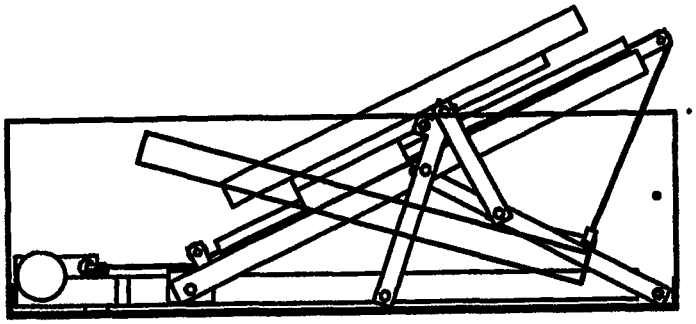
Figure 2G:
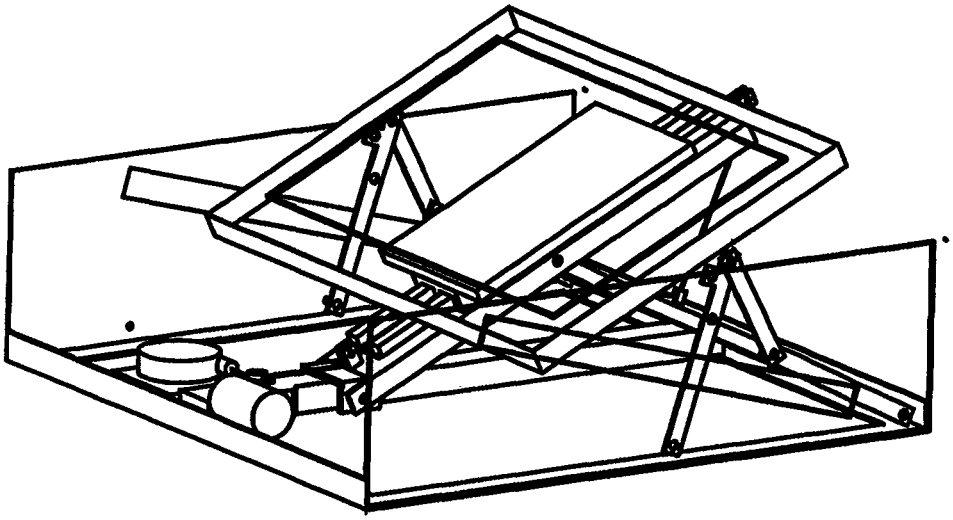
Figure 2C:
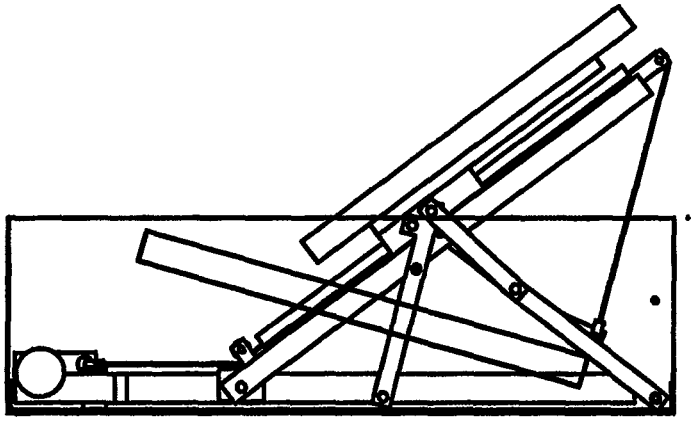
Figure 2H:
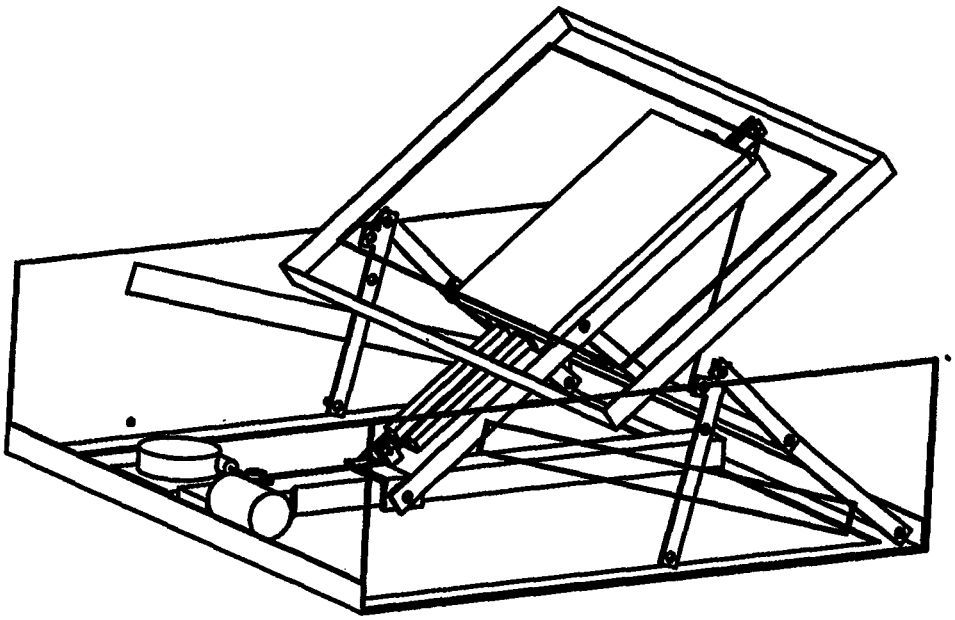
Figure 2D:
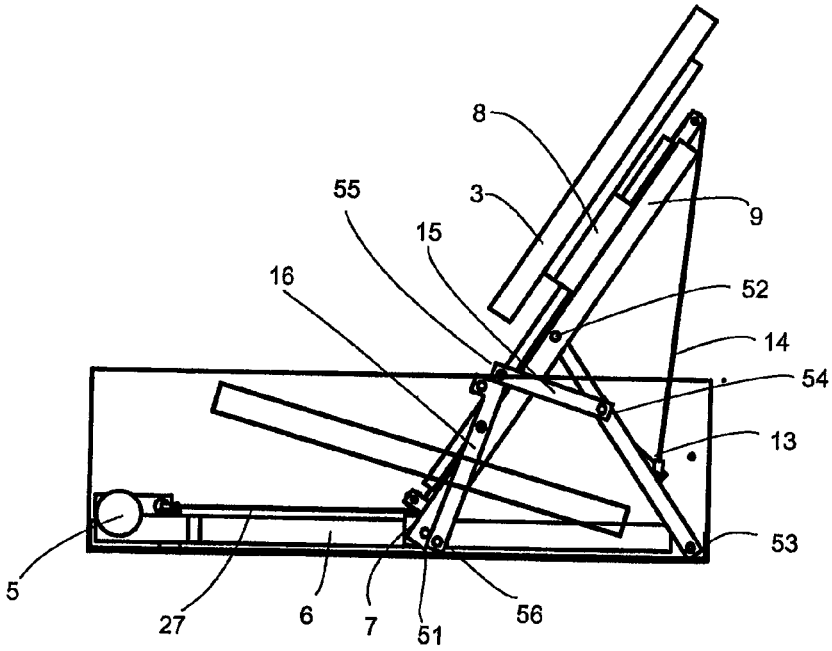
Figure 2I:
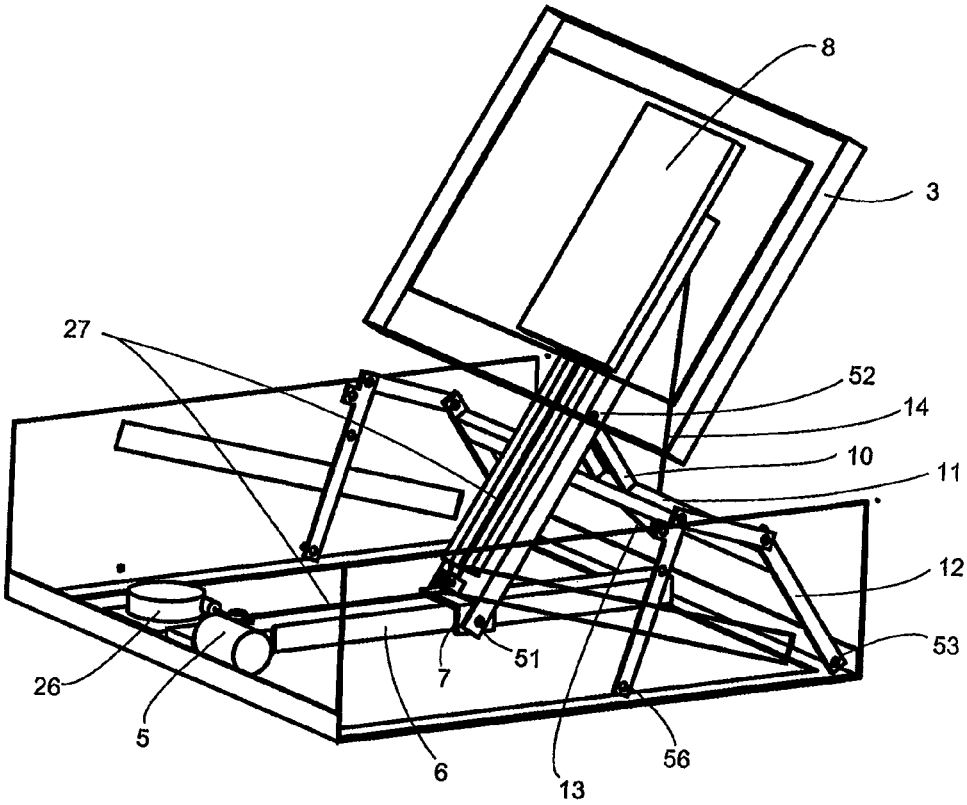
Figure 2E:
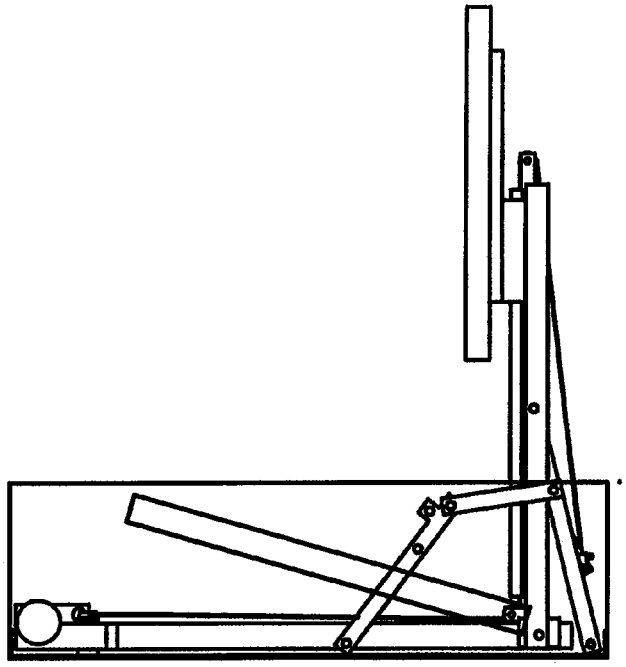
Figure 2J:
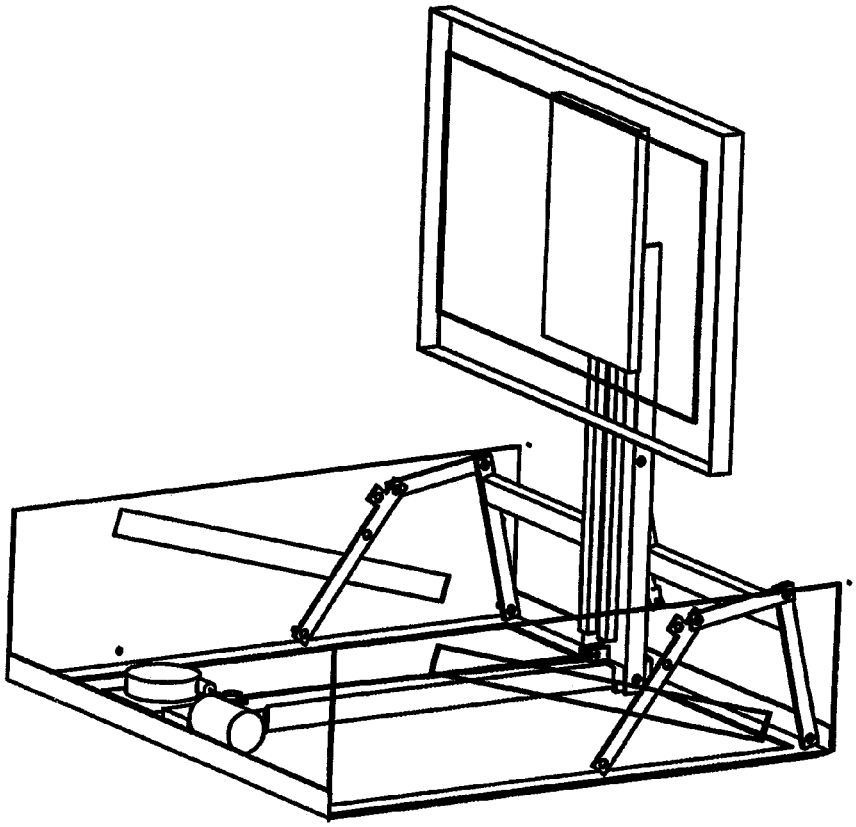

The movement of the visual screen/television device from the storage position to the operating position is illustrated in the FIGS. 2*a* up to and inclusive 2*j*. The parts that are playing an active role are best visible in the FIGS. 2*d* and 2*i*. With the electromotor 5 driving a further not visible screw spindle, slide 7 is moved over guide 6 from the first to the second stationary position. Slide 7 is at pivot point 51 connected to bracket 9 along which holder 8 with visual screen/television device 3 is slidably movable. At pivot point 52 pivot arm 10 is pivotally attached to bracket 9. Pivot arm 10 comprises two identical parts that each are pivotally attached to one side of bracket 9. The other end of pivot arm 10 is fixed to a horizontal yoke 11 that in its longitudinal direction is perpendicular to the longitudinal direction of bracket 9. At each of the ends of yoke 11 a yoke leg 12 is fixed. Each of the yoke legs 12 forms a right angle with yoke 11 so that the yoke legs 12 essentially are parallel to pivot arms 10. At an end away from the yoke 11, yoke legs 12 are pivotally attached to frame 4 in pivot points 53. In the middle of yoke 11 a cable rod is fixed that stands off from yoke 11 approximately in a direction opposite to that of the pivot arm 10. At the end of cable rod 13 away from yoke 11 a pulling cable 14 is attached that runs from cable rod 13 to an end of bracket 9 that is away from slide 7, and pulling cable 14 runs from there and is attached to holder 8. When starting from the stationary storage position using the electromotor 5 means the screw spindle moves slide 7 from the first stationary position to the second stationary position, then the combination of pivot arm 10, yoke 11 and yoke legs 12 force bracket 9 to move from its almost lying starting position to a vertical position in which the visual screen/television device gets to its operating position. Pulling cable 14 at the same time pulls holder 8 and the attached visual screen/television device 3 upwards along bracket 9 until the operating position that is displayed in FIGS. 2*i* and 2*j*.

In the description of the parts of the moving arrangement and rod system that makes both parts of the horizontal panel move back and forwards, most parts are executed in pairs and one part at each side of the cabinet. Both parts are identical and symmetrical with respect to a vertical centre plane of the cabinet. However, only one side will be described. The unit that is formed by pivot arm 10, yoke 11 and yoke legs 12 is also responsible for driving the movement of both parts of the horizontal panel 2', 2". At the end of each of the yoke legs 12 that is away from the pivot point 53, an end of the connection rod 15 is pivotally connected at pivot point 54. At the other end connection rod 15 is pivotally connected with an end of the central rod 16 at pivot point 55. Central rod 16 is at the other end pivotally connected to the frame in pivot point 56. Central rod 16 that is moved via connection rod 15 by yoke legs 12, is connected with those parts of the rod system that make move both parts 2', 2" of the horizontal panel.

The major part of the horizontal panel, part 2', is moved parallel to itself and keeps a horizontal position during the movement. Through the objects that are located on part 2' of the horizontal panel can remain there during movement of the panel.

Figure 3A:
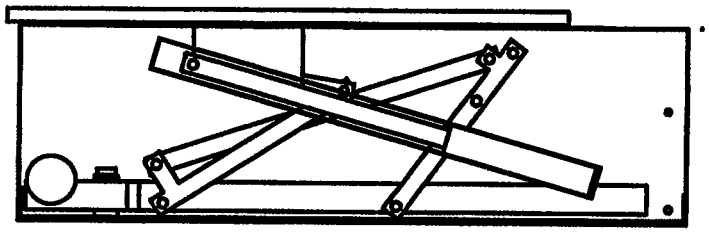
FIGS. 3*a-e* are comparable with FIGS. 1*a-e* but show only those parts that are important for the movement of a major part of the horizontal panel.
Figure 3F:
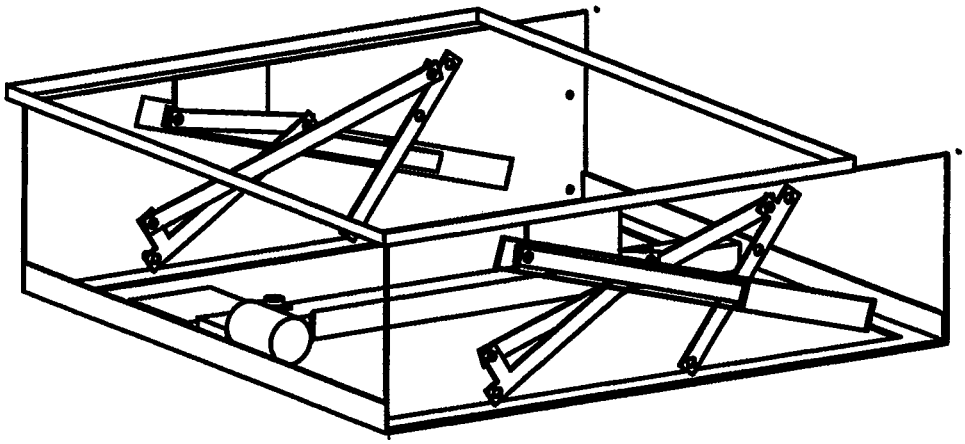
FIGS. 3*f-j* show views in isometric perspective of the FIGS. 3*a-e;*
Figure 3B:
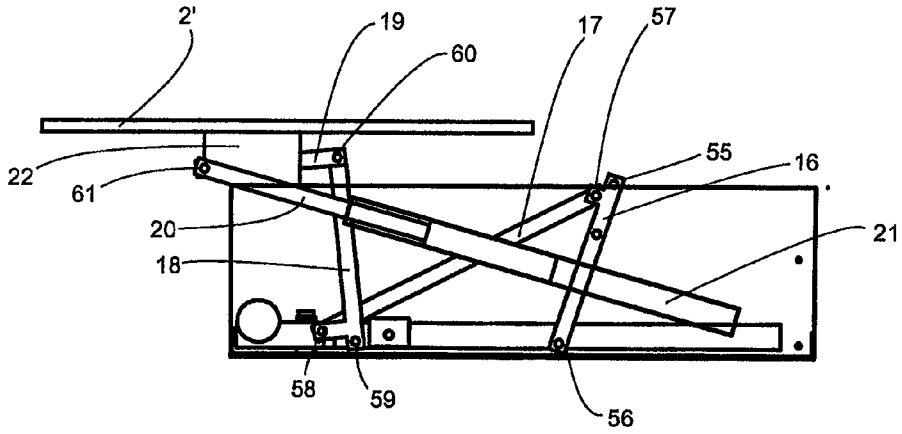
Figure 3G:
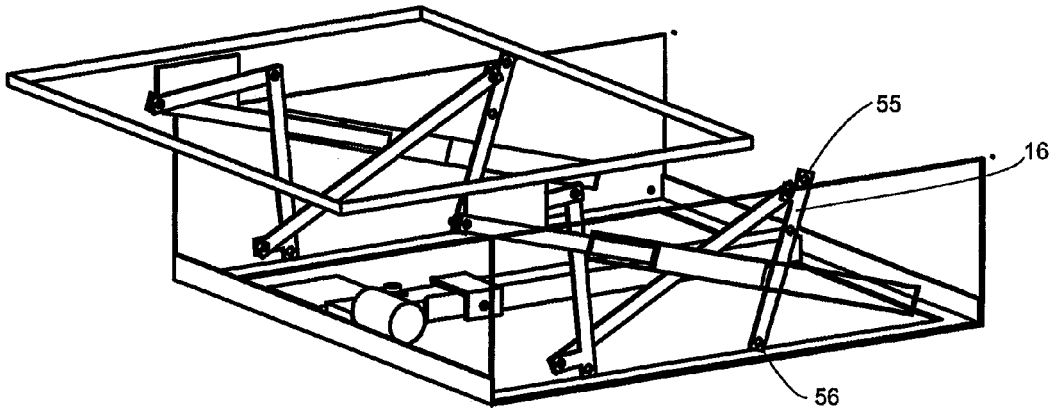
Figure 3C:
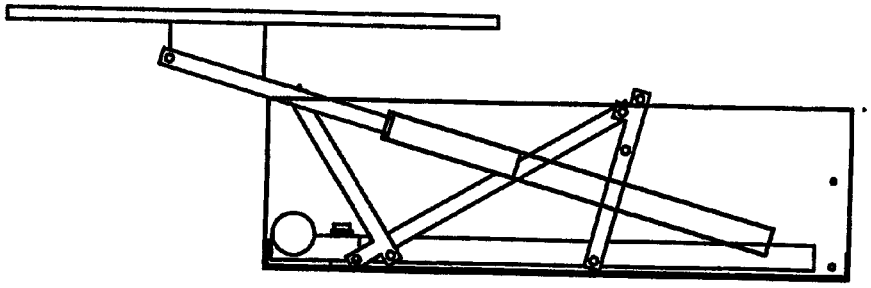
Figure 3H:
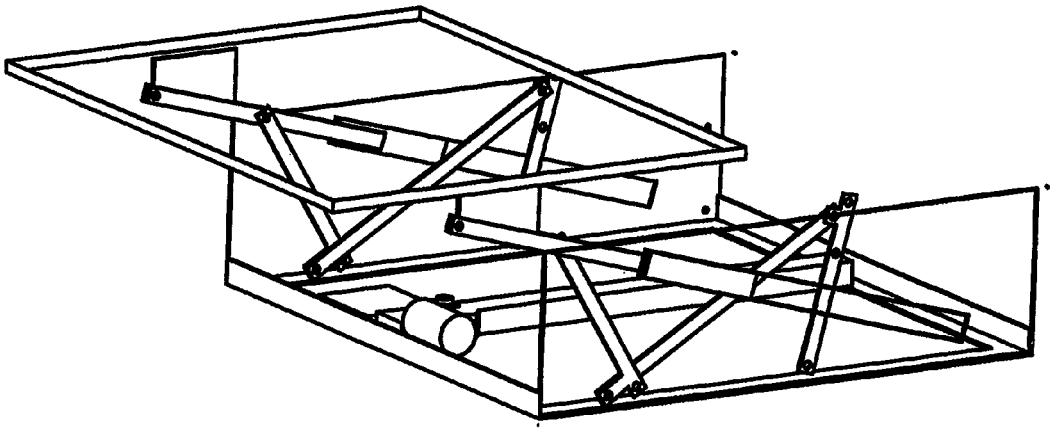
Figure 3D:
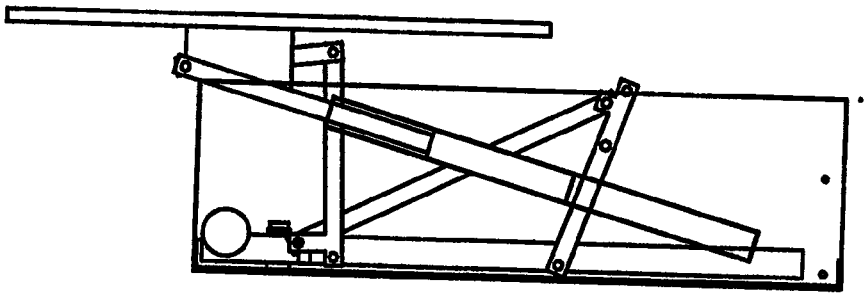
Figure 3I:
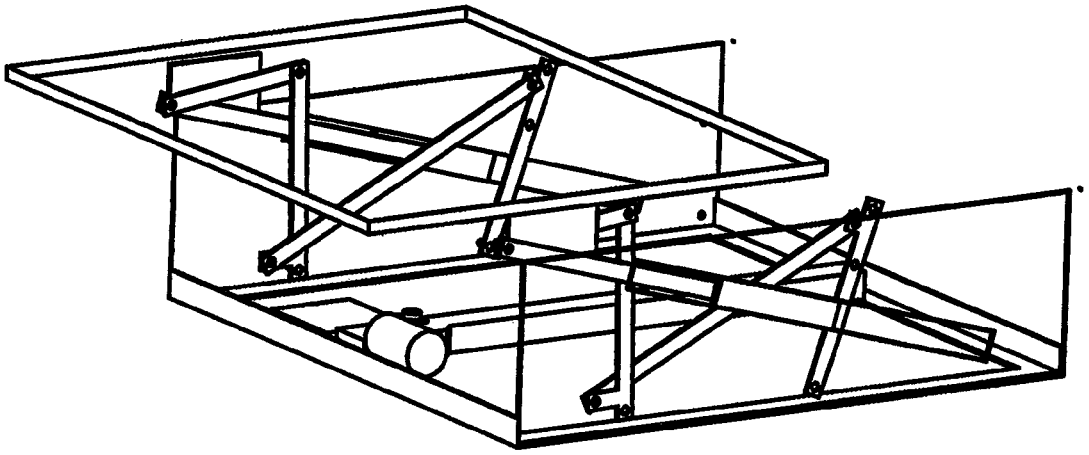
Figure 3E:
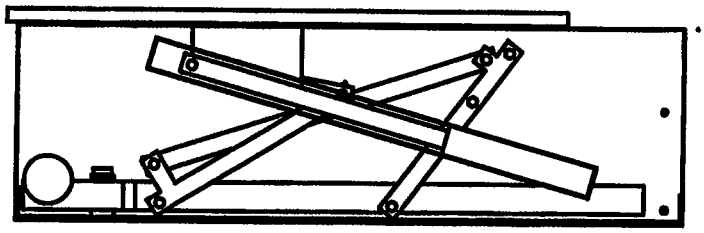
Figure 3J:
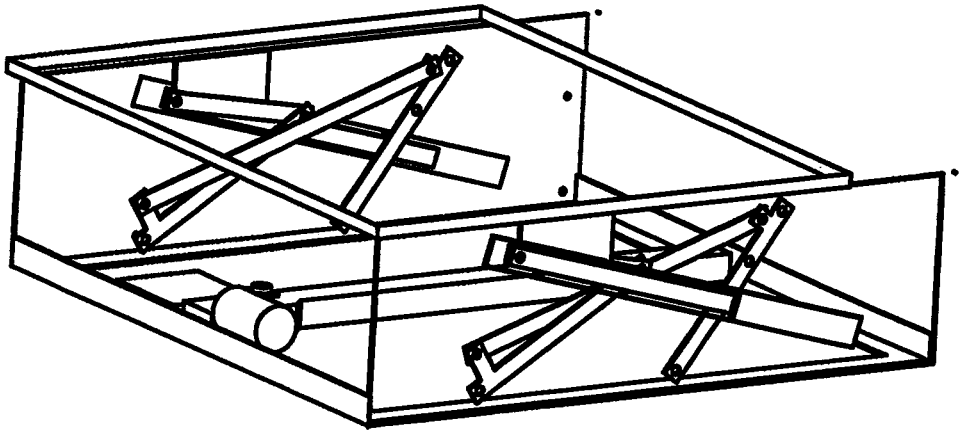

The parts that belong to the movement mechanism of part 2' of the horizontal panel are being described with reference to FIGS. 3*b* and 3*g*. Close to pivot point 55 one end of a first drive rod 17 is pivotally connected to a lip that extends from central rod 16 in pivot point 57. The other end of the first drive rod 17 is pivotally connected to pivot point 58 of a lip near the end of the second drive rod 18. Second drive rod 18 is at the end that is lies near to pivot point 58 pivotally connected to frame 4 at pivot point 59. At the other end the second drive rod 18 is pivotally attached to an end of the third drive rod 19 at pivot point 60. The third drive rod 19 is at the other end pivotally attached to panel slide 20 at pivot point 61. Panel slide 20 is in its longitudinal direction slidably connected to panel guide 21. Further panel slide 20 is fixed to part 2' of the horizontal panel via connection plate 22. Through the movements of central rod 16, when this is driven as described before, via first drive rod 17, second drive rod 18 and third drive rod 19, as well as via panel guide 20, part 2' of the horizontal panel is moved from its starting position as is shown in FIGS. 3*a* and 3*f* to a position in which panel part 2' partly comes to a position above and outside the cabinet so that a passage is being formed for visual screen/television device 3 with holder 8 and bracket 9 to move from the storage position to the operating position. In the second part of the movement as is shown in FIGS. 3*c-d* and 3*h-j* the panel moves back again to its starting position. During the whole movement panel part 2' will maintain its horizontal position. Further it will be clear that the part 2' of the horizontal panel is only connected with frame 4 and therefore with cabinet 1 via connecting plates 22 and the moving mechanism.

Figure 4A:
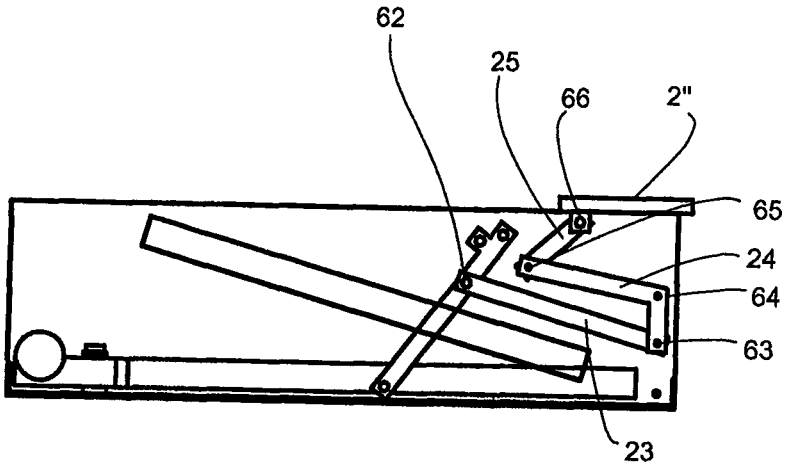
FIGS. 4*a-e* are comparable to FIGS. 1*a-e* and only show the parts that are of importance for the movement of the smallest part of the horizontal panel.
Figure 4F:
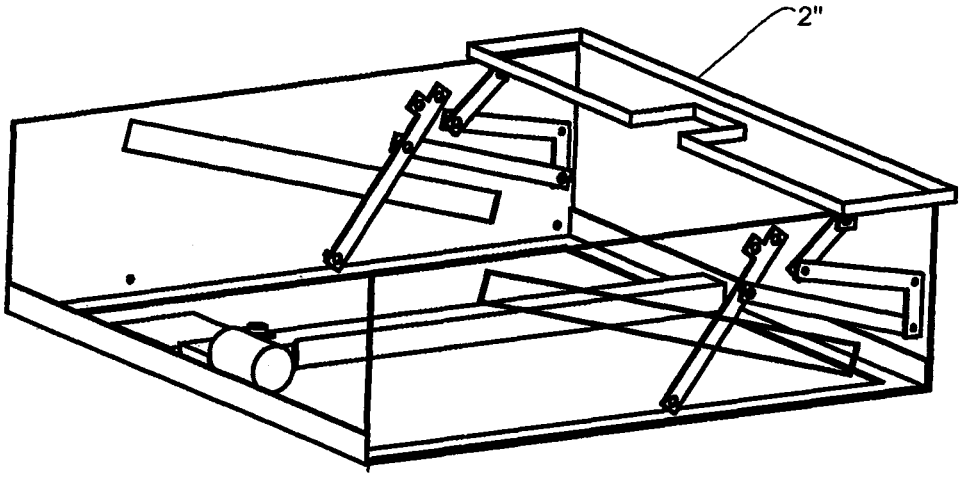
FIGS. 4*f-j* are views in isometric perspective of FIGS. 4*a-e.*
Figure 4B:
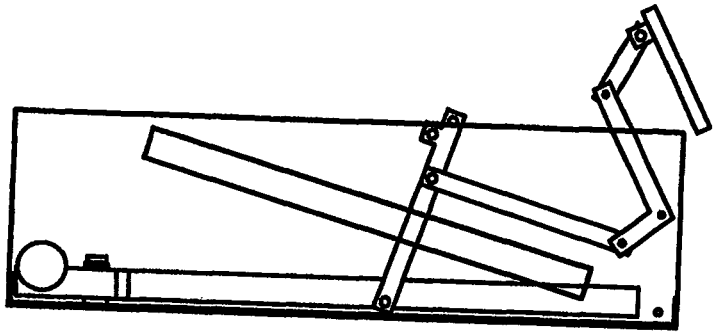
Figure 4G:
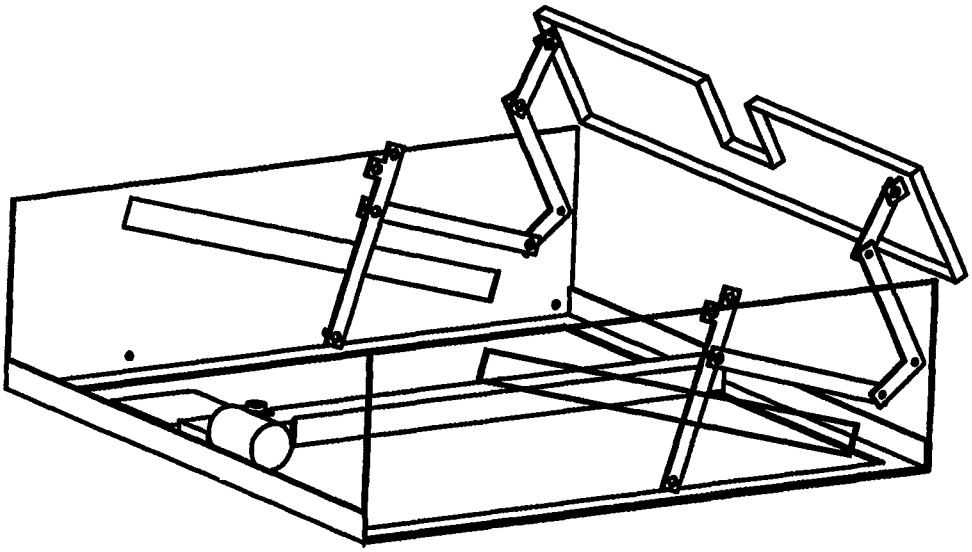
Figure 4C:
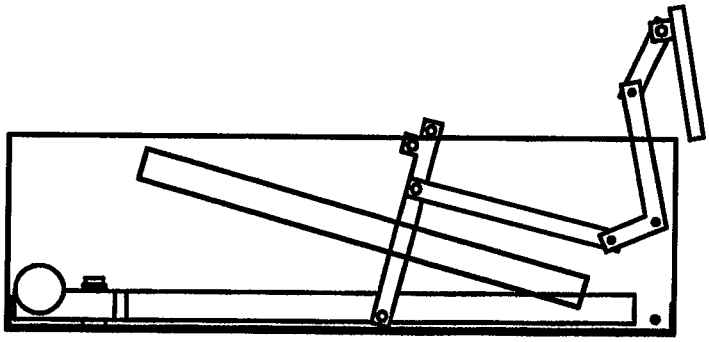
Figure 4H:
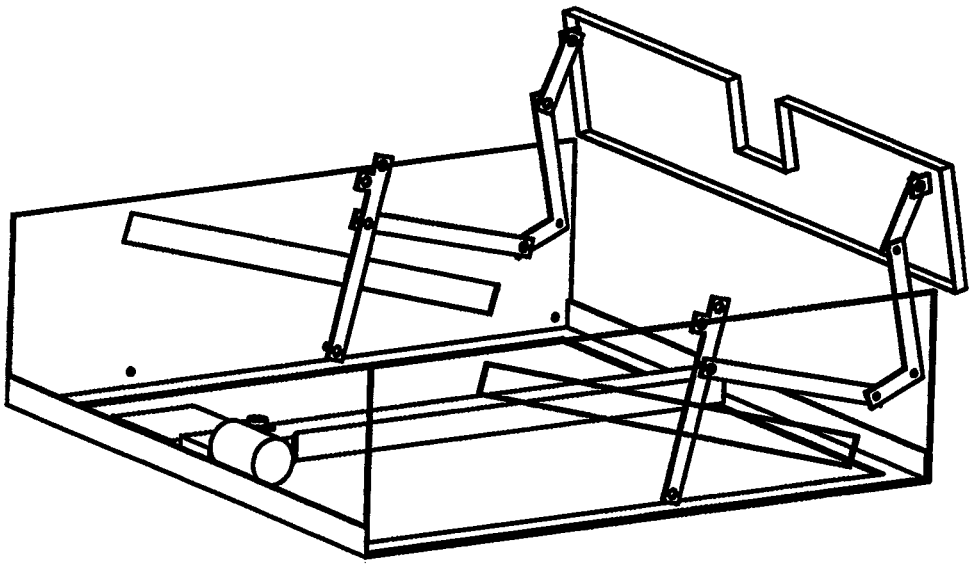
Figure 4D:
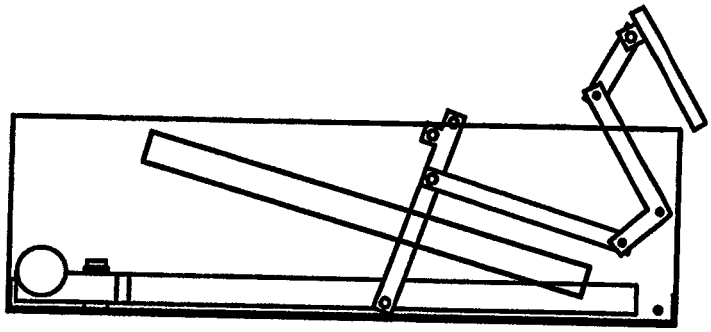
Figure 4I:
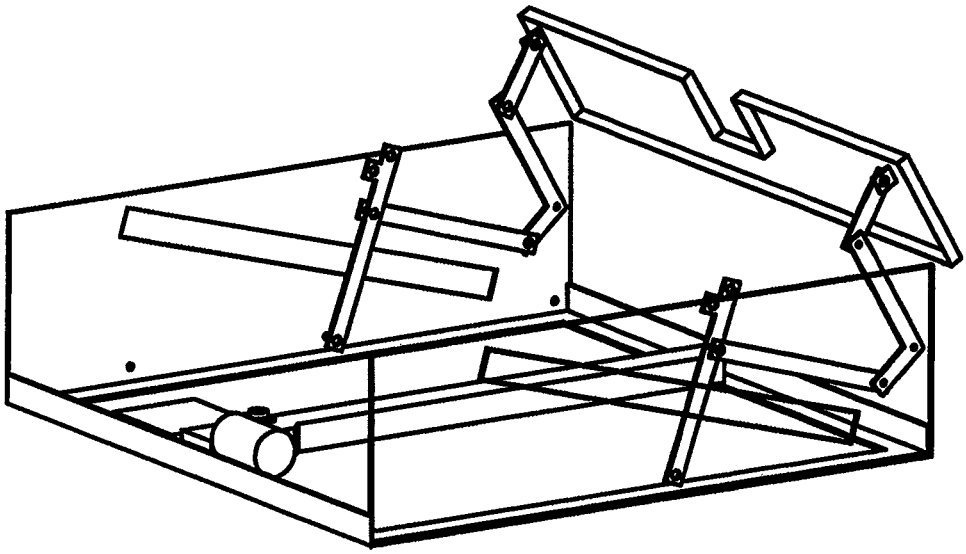
Figure 4E:
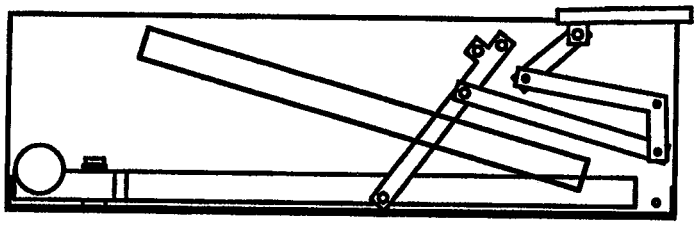
Figure 4J:
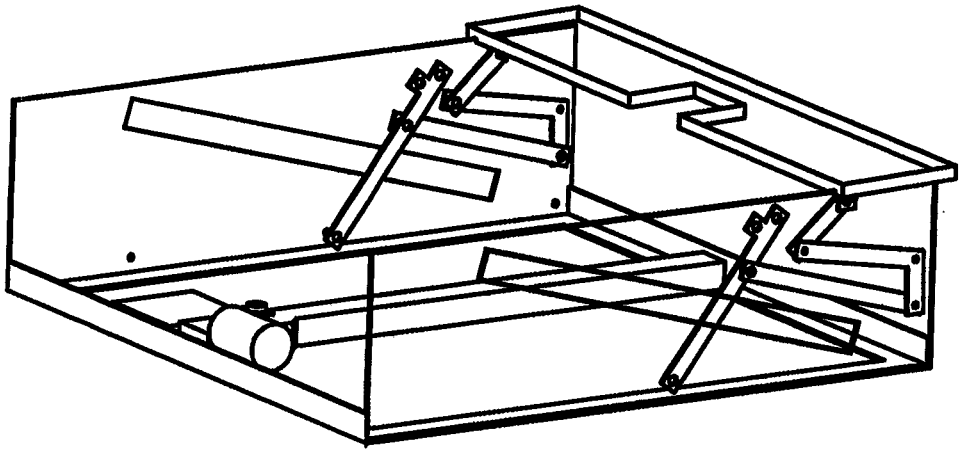

Now, with reference to FIGS. 4*a* and 4*f*, those parts of the moving mechanism will be described that are responsible for moving the panel part 2" of the horizontal panel. Further it should be noted that in FIG. 4*f* an opening is visible in panel part 2". In the storage position these opening are being filled by a part of panel 2" that can swing away, which for the sake of clarity is not explicitly shown. This part that can swing away will during movement from the storage position to the operating position be pushed up by the pulling cable 14 and when returning from the operating position to the storage position be pulled in position again by a spring element that also is not explicitly shown. The movement of panel part 2" will be described starting from the movement of the central rod 16. The movement of the central rod 16 is described above and linked to the movement initiated by the drive via slide 7. At a predetermined pivot point 62 at the central rod 16 an end of fourth drive rod 23 is connected pivotally. Fourth drive rod 23 is at its other end pivotally connected with an end of toggle link 24 at pivot point 63. Toggle link 24 is near the toggle point of toggle link 24 pivotally connected with frame 4 in pivot point 64. The other end of toggle link 24 is pivotally connected with an end of the fifth drive rod 25 in pivot point 65. Fifth drive rod 25 is at its other end pivotally connected with panel part 2" in pivot point 66. Pivot point 66 is situated near the dividing line of panel part 2" with panel part 2' in the starting position. In FIGS. 4*a* to 4*e* and 4*f* to 4*j* can be seen that the panel part 2' through the earlier described driven movement of the central rod 16 first moves from the horizontal position to a vertical position and subsequently returns again to the horizontal position. It should be noted here that panel part 2" is pivotally connected to frame 4 in a way that is not further shown. Its pivot axis lies near the end of the horizontal panel and is essentially parallel with the dividing line between panel 2' and panel 2".

Because in FIGS. 2, 3 and 4 central rod 16 has the same position in the figures with the same letter indication, it is clear that the described movements take place simultaneously.

In moving the visual screen/television device from the operating position to the storage position all movements that have been described above take place in the reverse direction. A possible exception to this is formed by the movement of holder 8 with visual screen/television device 3 downwards along the bracket 9. This movement is caused by gravity. Because the angle that bracket 9 in the storage position makes with the horizontal plane is smaller than 30 degrees, this angle can become so small (in possible embodiments of the invention also 0°) that the influence of the gravity is insufficient to move holder 8 and visual screen/television device 3 along bracket 9. To prevent that holder 8 and visual screen/television device 3 get stuck prematurely, a cable roller 26 including a spring is mounted to frame 4, next to electromotor 5, see FIG. 2*i*. From cable roller 26 second pulling cable 27 runs along guide 6, over a roller at the bottom side of bracket 9 and is connected to the bottom side of holder 8. Through the tension of the spring in cable role 26 a pulling force downward is executed on holder 8 and through this on visual screen/television device 3, so that these always will return to the desired storage position, also when holder and visual screen/television device make a very small angle with the horizontal plane in this position.

Although an embodiment of the invention is shown, it will be clear that many variants to this are possible, e.g. by a slightly different embodiment of the rod systems. The same or similar movements can be achieved in equivalent ways without deviating of the attached claims.

LIST OF REFERENCE NUMBERS

1 Cabinet
2 Horizontal panel
2', 2" Parts of horizontal panel 2
2' Larger Panel/Lower Side Part
2" Smaller Panel/Pivoting Part
3 Visual screen/television device
4 Frame
5 Electromotor
6 Guide
7 Slide
Screw Spindle (unnumbered)
8 Holder
9 Bracket
10 Pivoting arm
11 Yoke
12 Yoke legs
13 Cable rod
14 First pulling cable
15 Connection rod
16 Central rod
17 First drive rod
18 Second drive rod
19 Third drive rod
20 Panel slide/Guiding element
21 Panel guide/Stationary guiding element
22 Connection plate
23 Fourth drive rod
24 Toggle link
25 Fifth drive rod
26 Cable roller with spring
27 Second pulling cable
Pivot Points
51 Slide/bracket—first pivot point
52 Bracket/pivot arm—second pivot point
53 Yoke leg/frame
54 Yoke leg/connecting rod
55 Connecting rod/central rod
56 Central rod/frame
57 Central rod/first drive rod
58 First drive rod/second drive rod
59 Second drive rod/frame
60 Second drive rod/third drive rod
61 Third drive rod/panel slide
62 Central rod/fourth drive rod
63 Fourth drive/toggle link
64 Toggle link/frame
65 Toggle link/fifth drive rod
66 Fifth drive rod/panel part 2'

Note that for the purposes of the claims, "arrangement" refers to reference numerals 4-27; "means of movement" refers to numerals 15-25; "system of rods" refers to numerals 11-13 and 15-25; "drive" refers to numerals 5-8 and unnumbered screw spindle; and "parts of arrangement below horizontal" in the operating position refers to numerals 4-7, 11-13, and 15-25.

What is claimed:

1. A cabinet comprising a holder for attaching thereto a device comprising a display screen, the cabinet comprising at least one horizontal panel, defining by its external horizontal face a panel plane, an arrangement for moving the holder between two positions, wherein in a first position, called storage position, the holder is stored below a horizontal panel with the holder in a lying position in which the holder forms an angle with the horizontal plane that is smaller than 30° and in a second position, called operating position, the holder is located externally of the cabinet above the horizontal panel in a standing, essentially vertical position, in which the arrangement comprises movement means for moving the horizontal panel away from a rest position and moving it back to the rest position to provide a passage for the holder when the holder is being moved between the two positions, wherein the holder is connected to a bracket that in the operating position is extended under the holder downwards outside the holder and the arrangement for moving the holder comprises:

a frame that is fixed to the cabinet, a drive attached to the frame, a guide attached to the frame, a slide that by means of the drive is movable forward and backward along the guide between two stationary positions, wherein a first stationary position belongs to the storage position of the holder and a second stationary position belongs to the operating position of the holder, wherein the slide and the bracket, pivotally are connected with each other at a first pivot point of the bracket, a pivot arm that is pivotally connected at one end with the bracket at a second pivot point, that is spaced apart at a predefined distance of the first pivot point, and a system of rods that is fixed to the pivot arm, wherein each of the rods of the system has a fixed or a pivoting connection with one or more other rods of the system or with the frame and in which the movement means for moving the horizontal panel are part of the system of rods.

2. A cabinet according to claim 1, wherein the holder is slidably connected with the bracket and the holder is movable along the bracket by means of a first pulling cable.

3. A cabinet according to claim 1, wherein the horizontal panel is executed in two parts.

4. A cabinet according to claim 1, wherein to a lower side part of the horizontal panel at least one guiding element is connected that cooperates with a stationary guiding element and the movement means for moving the horizontal panel are engaging the guiding elements in such a way, that during the moving of the horizontal panel away from the rest position and moving it back to the rest position that the lower side part of the horizontal panel maintains a horizontal orientation.

5. A cabinet according to claim 4, wherein the horizontal panel comprises a pivoting part that can pivot out of the panel plane for providing a passage for the bracket, the pivot arm and the first pulling cable in the operating position of the holder.

6. A cabinet according to claim 1, wherein in the storage position the holder and all elements of the arrangement for moving the holder are located below the horizontal panel and in the operating position the holder and a part of the bracket, of the pivot arm and of the first pulling cable are situated above the horizontal panel and all other parts of the arrangement are situated below the horizontal panel.

7. A cabinet according to claim 1, wherein the drive comprises an electromotor with a transmission that is coupled with the electromotor and the slide.

8. A cabinet according to claim 7, wherein the transmission comprises a pulling cable.

9. A cabinet according to claim 7, wherein the transmission comprises a screw spindle.

10. A cabinet according to claim 1, wherein in the lying position the holder forms an angle with the horizontal plane that lies between 9° and 11°.

11. A cabinet according to claim 1, wherein the drive comprises a control and the control controls the drive in such a way that at least a part of the horizontal panel other than the pivoting part is submitted to an acceleration that does not exceed a predefined threshold value.

12. A cabinet according to claim 1, wherein the drive can be operated by remote control.

* * * * *